United States Patent [19]

Rangwala et al.

[11] Patent Number: 4,683,701

[45] Date of Patent: Aug. 4, 1987

[54] CONTAINER STERILIZATION APPARATUS

[75] Inventors: Badrudden K. Rangwala, Farmington Hills; Frank A. Rodocker, Milford; Curtis H. Pawloski; Richard L. Joosten, West Bloomfield, all of Mich.

[73] Assignee: Ex-Cell-O Corporation, Troy, Mich.

[21] Appl. No.: 829,045

[22] Filed: Feb. 13, 1986

[51] Int. Cl.[4] ..... A61L 2/00; B65B 55/10

[52] U.S. Cl. ..... 53/167; 53/426; 53/568; 422/302; 422/304

[58] Field of Search ..... 422/302, 304, 28, 37; 53/426, 167, 568, 493, 575

[56] References Cited

U.S. PATENT DOCUMENTS

| | | | |
|---|---|---|---|
| 3,486,295 | 12/1969 | Rausing et al. | 53/426 |
| 4,409,188 | 10/1983 | Silberzahn | 422/28 |
| 4,566,251 | 1/1986 | Spisak et al. | 53/426 |
| 4,590,734 | 5/1986 | Ueda | 53/167 |
| 4,590,740 | 5/1986 | Rodocker | 53/426 |

FOREIGN PATENT DOCUMENTS

| | | | |
|---|---|---|---|
| 1062782 | 3/1967 | United Kingdom | 422/302 |

*Primary Examiner*—David L. Lacey
*Assistant Examiner*—Lori-Ann Cody
*Attorney, Agent, or Firm*—John P. Moran

[57] ABSTRACT

A sterilization apparatus for sterilizing the interiors of paperboard containers, wherein such apparatus is operative prior to the container being mounted on a mandrel of a mandrel assembly on which the container bottom closures are formed, closed and sealed. This is accomplished by providing nebulizing means for communicating a suitable sterilant fog through and onto the inside surfaces of the carton blank from the time that it is removed from a magazine and while being opened into a four-sided tubular shape, thereby greatly increasing the total interior sterilizing time available prior to the container being filled downstream, as compared to conventional sterilization processes which are operative after the bottom panels of the carton have been closed and sealed. Heated air is supplied to each mandrel of the mandrel assembly and applied to the interior of the container while the container is mounted thereon.

8 Claims, 13 Drawing Figures

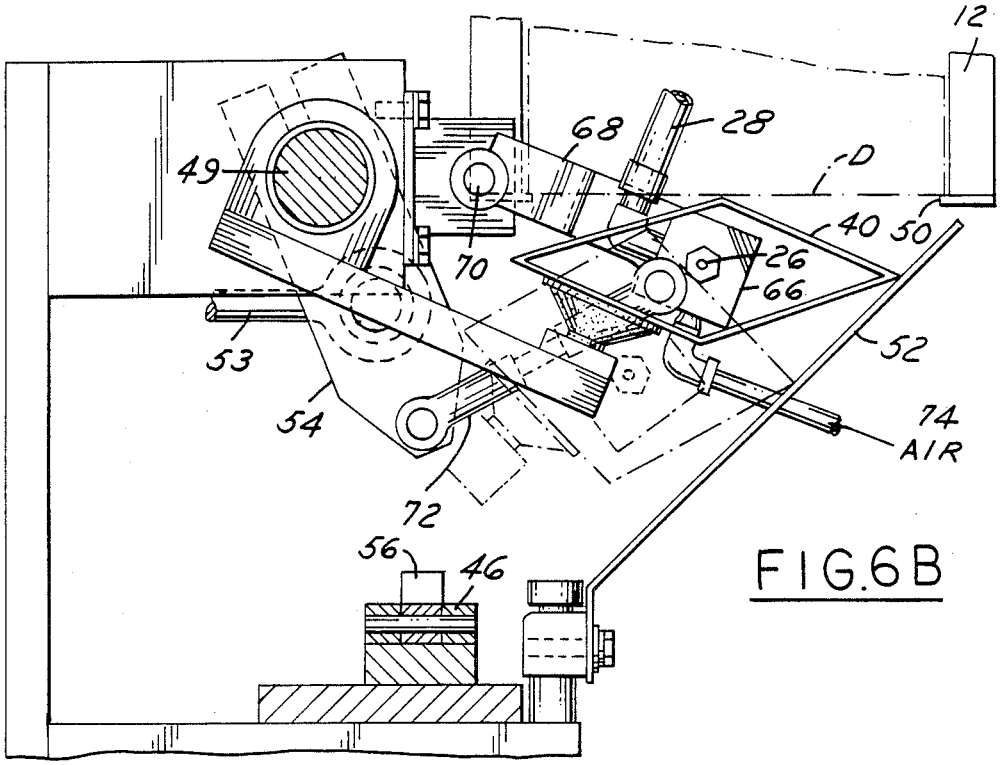
FIG.6B
FIG.7
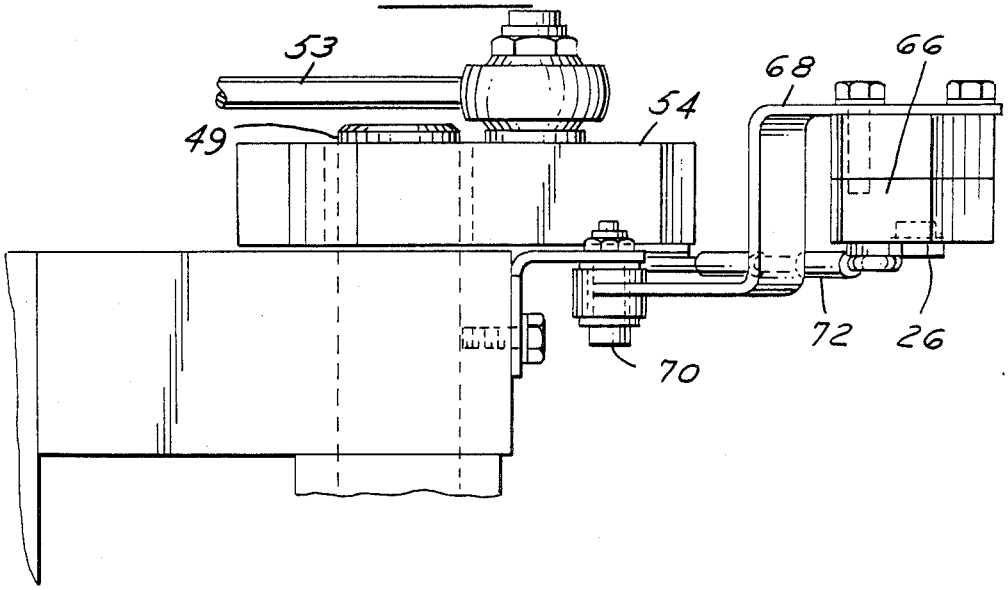

CONTAINER STERILIZATION APPARATUS

TECHNICAL FIELD

This invention relates generally to sterilization techniques and, more specifically, to an improved apparatus and method for sterilizing thermoplastic coated, liquid carrying paperboard containers prior to their being filled with a liquid and sealed on a conventional forming, filling and sealing machine.

BACKGROUND ART

It is desirable from a marketing standpoint to increase the storage or shelf life of various comestible products. This is accomplished by employing a sterilization process in conjunction with the forming, filling and sealing operations. Heretofore, sterilization of thermoplastic coated, liquid carrying paperboard containers has typically been accomplished on the forming, filling and sealing machine at a location between the station where the bottom formed container is stripped from an indexing mandrel and a station downstream thereof where the container is filled with a liquid, such as milk or juice. Such an arrangement is shown and described in Lisiecki U.S. Pat. No. 3,566,575, issued Mar. 2, 1971.

It is also known to use a sterilization apparatus and process wherein a channel is formed through the length of each mandrel of a typical indexing sprocket and mandrel assembly, with the channel communicating with openings and compartments formed in the hub of the indexing sprocket and mandrel assembly, such that as each mandrel reaches the 6:00 position, there is communication with a line leading from a generator which is capable of continuously producing a chlorine dioxide or hydrogen peroxide fog, thereby conveying such fog through the compartment and respective channels to the interior of each container as the latter is being mechanically stripped from the mandrel upon which it is slidably mounted. Such an arrangement is shown and described in commonly asigned Joosten and Davis patent application Ser. No. 368,940, filed Apr. 16, 1982 issued as U.S. Pat. No. 4,506,491 on Mar. 26, 1985.

As the effect of a sterilization process is dependent upon both sterilizing time and temperature, there is a need for a sterilization apparatus and method which maximizes both these variables on machines wherein the longitudinal distance between the mandrel and the filling station is limited.

DISCLOSURE OF THE INVENTION

A general object of the invention is to provide improved sterilization apparatus and process which are are highly efficient with respect to maximum sterilizing time and accompanying temperature.

A further general object of the invention is to provide improved sterilization apparatus and process which are compatible with existing forming, filling and sealing machines.

Another object of the invention is to provide improved sterilization apparatus and process which are functional intermediate a magazine containing flattened paperboard container blanks and the indexing sprocket and mandrel assembly currently included on many models of forming, filling and sealing machines.

A further object of the invention is to provide a sterilization apparatus and process wherein an atomizing or nebulizing nozzle is located on a forming, filling and sealing machine so as to dispense a suitable sterilant in a fog state into and through a tubular, open ended carton blank, just after the blank has been removed in a folded-over, flattened state form a magazine and while being moved therefrom and opened in the usual manner, to a point just prior to the time that the tubular blank is slidably mounted on a mandrel of a forming, filling and sealing machine.

These and other objects and advantages of the invention will be apparent when reference is made to the following description and accompanying drawings.

BRIEF DESCRIPTION OF THE DRAWINGS

FIGS. 6A, 6B and 6C are cross-sectional views taken along the planes of the lines 6A—6A, 6B—6B, and 6C—6C of FIG. 5, respectively and looking in the direction of the arrows, but illustrating different operational positions; and FIG. 7 is a cross-sectional view taken along the plane of the line 7—7 of FIG. 6A, and looking in the direction of the arrows.

BEST MODE OF CARRYING OUT THE INVENTION

Figure 1:
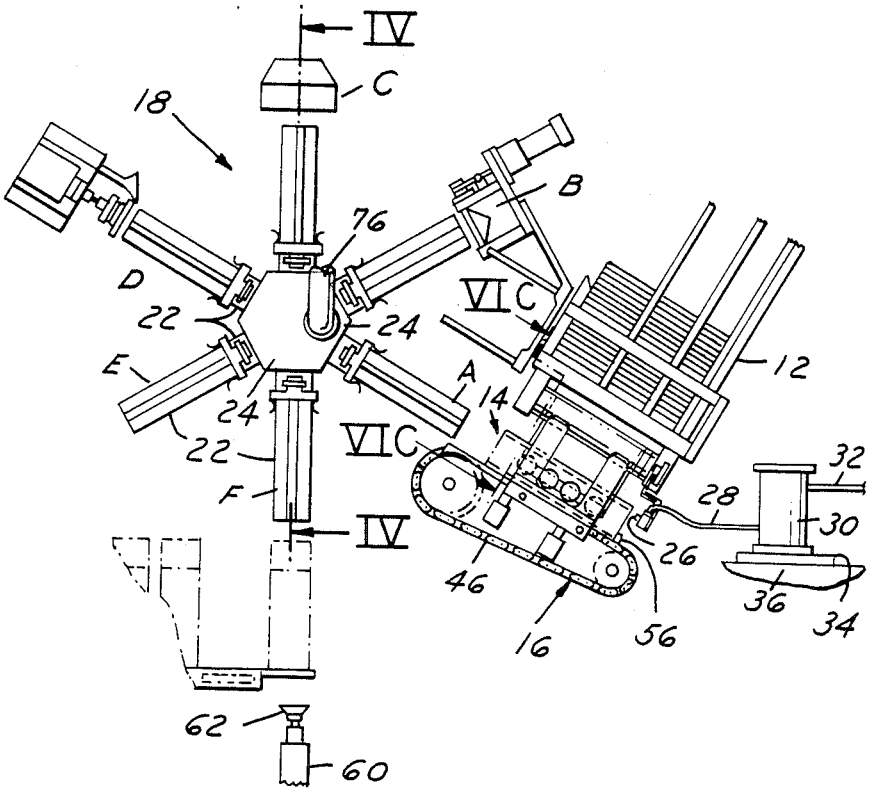
FIG. 1 is a fragmentary side elevational view of a forming, filling and sealing machine embodying the invention.
Figures 2, 3A, 3B, 3C, 3D:
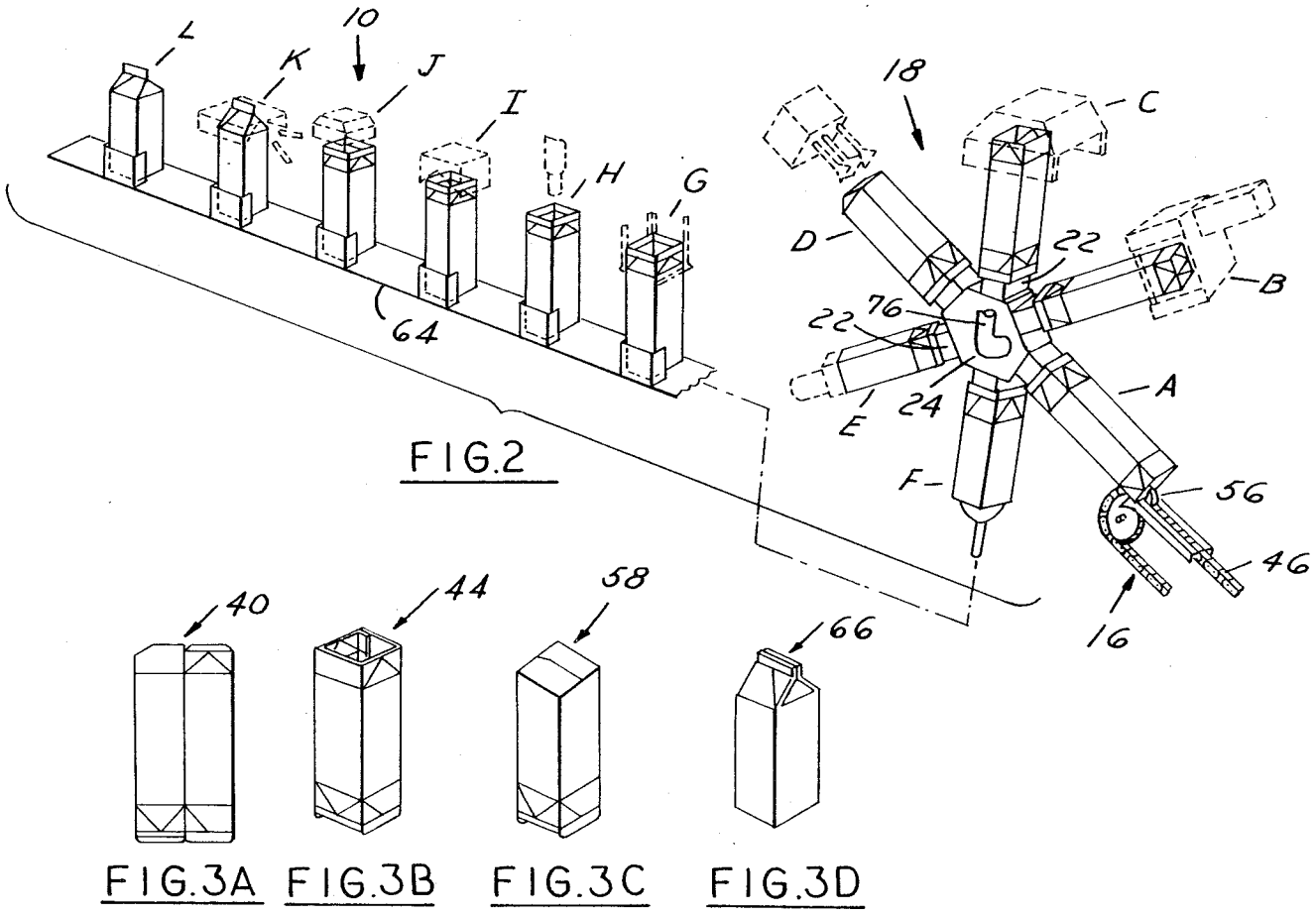
FIG. 2 is a perspective schematic view illustrating typical operations performed on a container as it travels through a forming, filling and sealing machine.
FIG. 3A is an illustration of a typical folded-over, flattened and side seamed container blank suitable for being loaded into the magazine of a forming, filling and sealing machine.
FIG. 3B is a perspective view of the container blank shown in FIG. 3A in open-ended, tubular form as it appears prior to and while being mounted on a mandrel at Station A to FIG. 2.
FIG. 3C is a perspective view of the container after the bottom closure panels have been sealed at station D in FIG. 2.
FIG. 3D is a perspective view of a filled and sealed container after passing through to the discharge station of the machine, represented as L, in FIG. 2.
Figure 4:
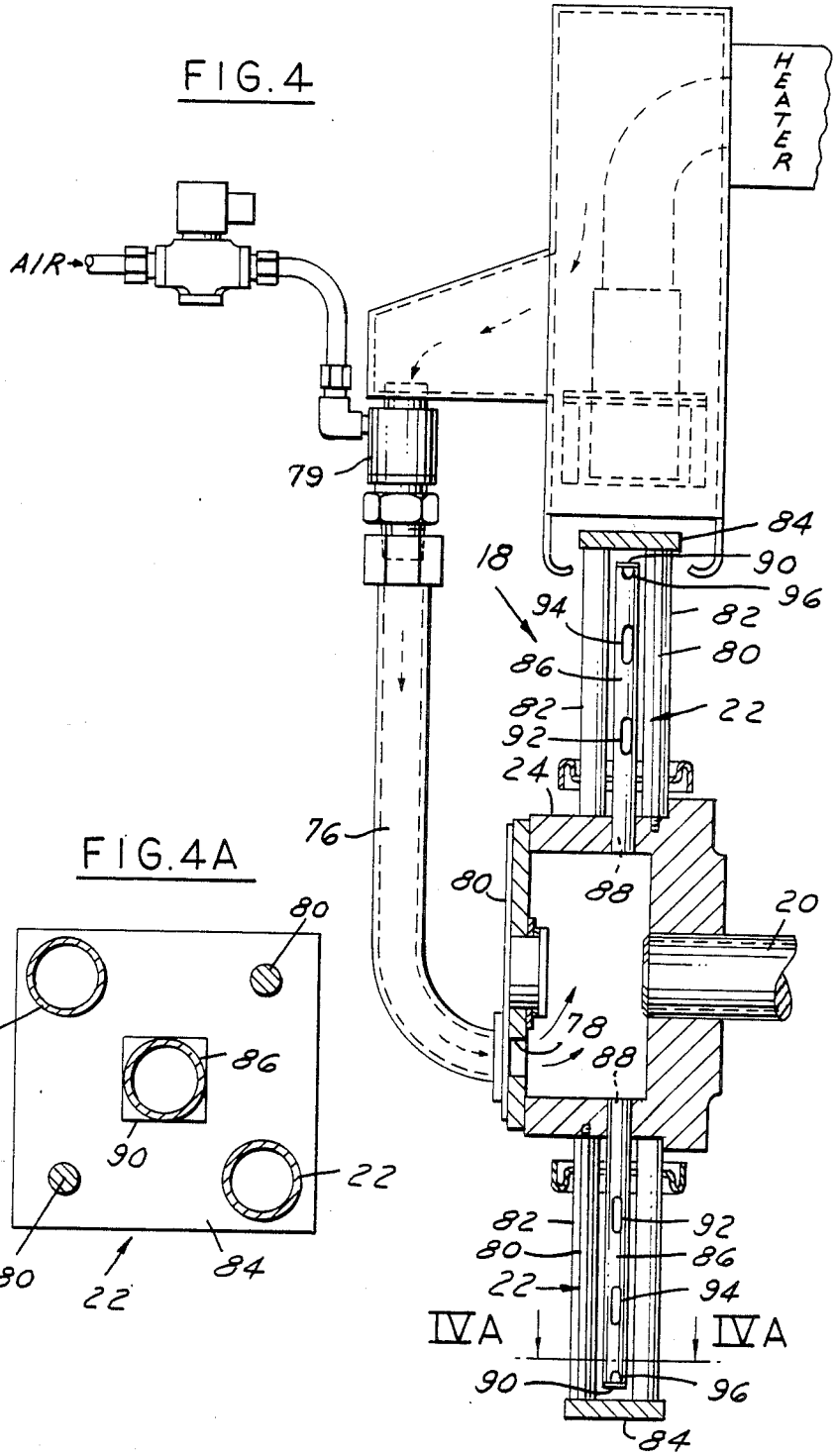
FIG. 4 is a cross-sectional view taken along the plane of the line 4—4 of FIG. 1, and looking in the direction of the arrows.

Referring now to the drawings in greater detail, FIGS. 1 and 2 illustrate a conventional forming, filling and sealing machine 10, including a magazine 12, a blank feeder assembly 14, a blank loader assembly 16, and an indexing mandrel assembly or bottom closing mechanism 18 mounted on a drive shaft 20 (FIG. 4). The assembly 18 includes six equally spaced mandrels 22 extending radially from a hub 24 mounted on the drive shaft 20. The mandrels 22 are designed such that each have four open sides 25 (FIG. 4), for a purpose to be explained.

As shown in FIG. 1, there is also included a nebulizing nozzle 26 mounted intermediate the magazine 12 and the loader assembly 16, and adapted to spray a fog or mist. Connected to the nebulizing nozzle 26 is a flexible line 28 which leads from suitable means, such as a pressurized tank 30, connected via a line 32 to a source (not shown) of a suitable sterilizing fluid under pressure. The generator is mounted on a suitable platform 34 on the frame, represented at 36, of the machine 10.

The feeder and loader assemblies 14 and 16 are adapted generally to withdraw blanks successively from the magazine 12, erect them into an open-ended tubular form, and then load them onto respective mandrels 22 of the bottom closing mechanism 18. For such purpose, these mechanisms are driven in synchronism with each other from the main drive of the machine 10.

Figure 5:
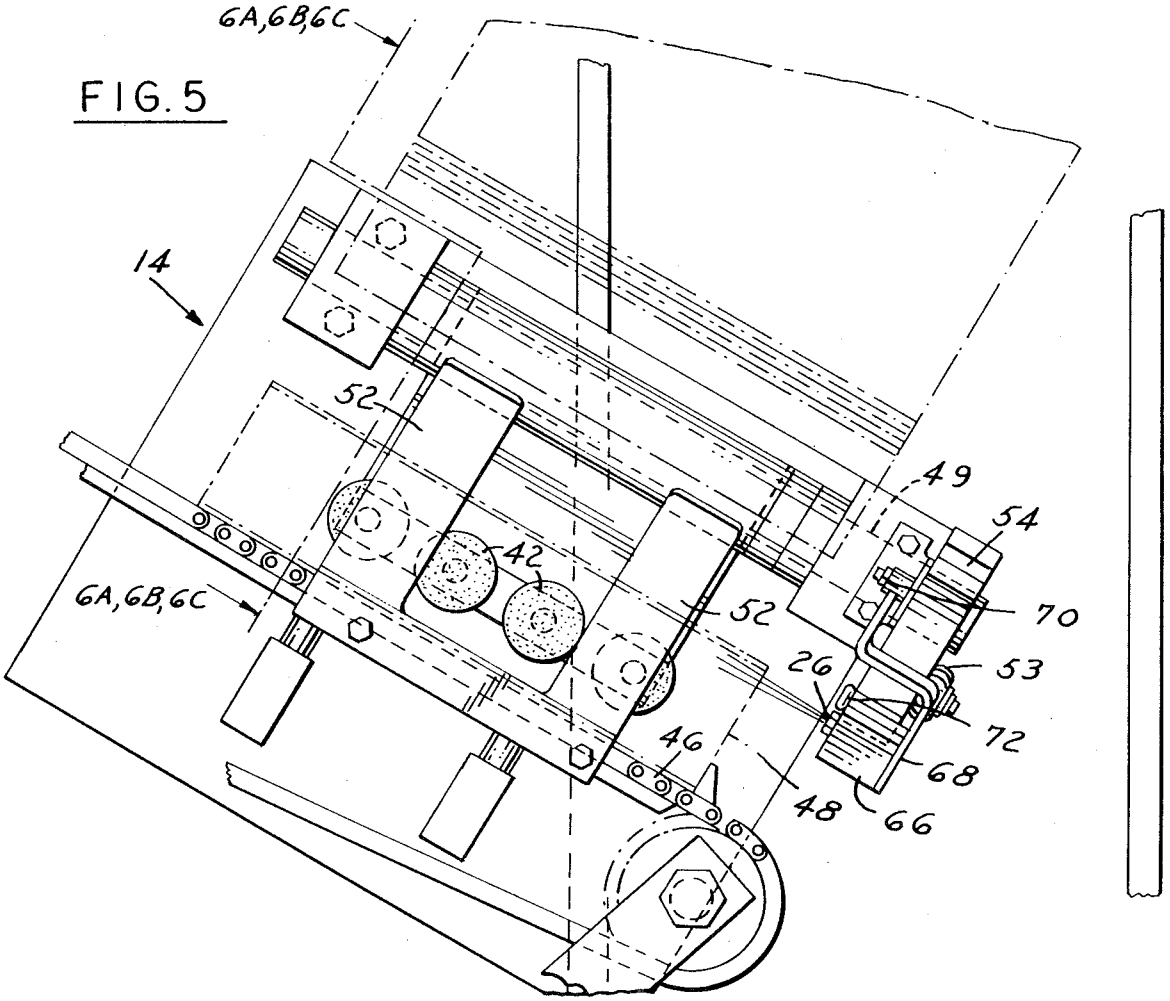
FIG. 5 is an enlarged view of a portion of the FIG. 1 structure.

Conventionally, a thermoplastic coated paperboard container blank 40 (FIG. 3A) is removed by vacuum pick-up or suction cups 42 (FIG. 5) from the magazine 12 (FIG. 1), causing the blank 40 to open into a four-sided tube 44 (FIG. 3B), and deposited upon a small endless chain conveyor 46 (FIG. 1). The conveyor 46 moves the tube 44 toward and onto one of the mandrels 22 at a load station A located in the 4:00 o'clock position, as viewed in FIG. 1. The nebulizing nozzle 26 is located adjacent the rear edge of the blank 40, and caused, in a manner to be described, to travel with the blank while it is being opened into the tube 44 shape, to thereupon remain aimed at the variable opening.

Figure 6A:
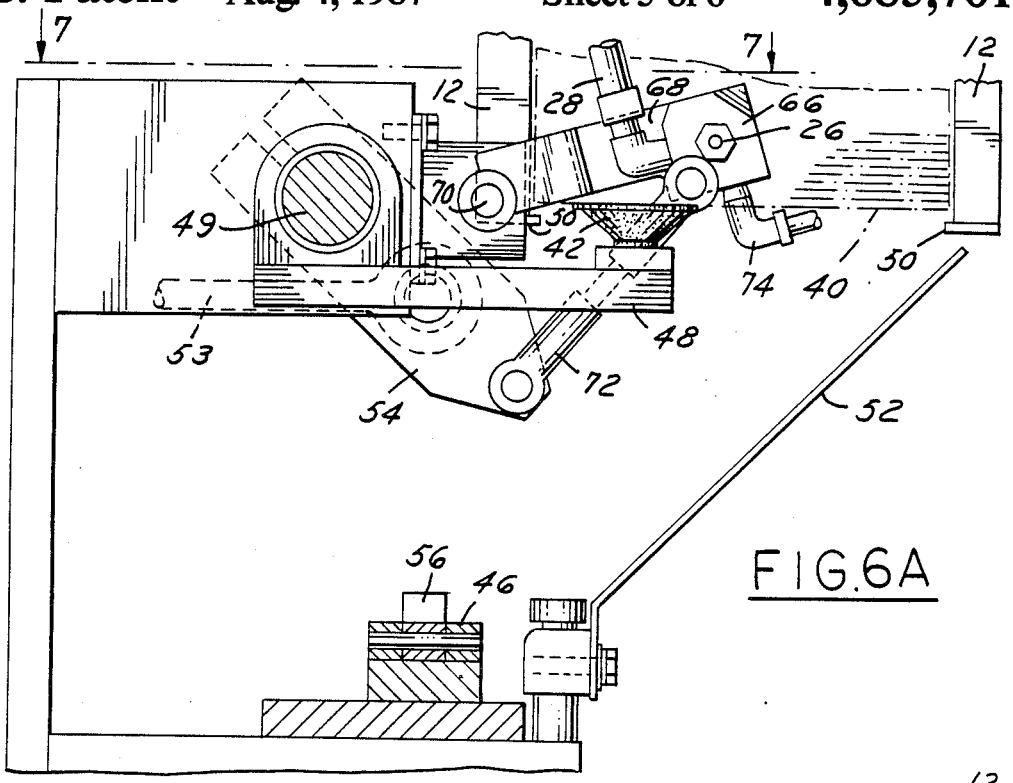
Figure 6C:
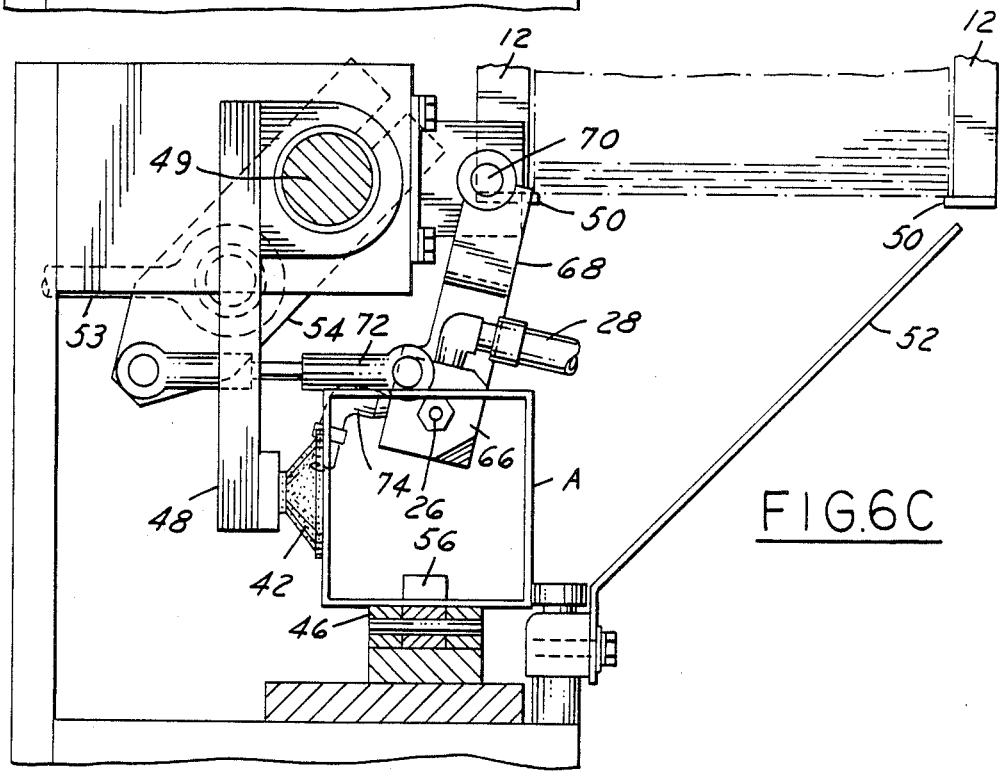

Typically, the blank feeder assembly 14 (FIG. 5) comprises a gate member or arm 48 (FIG. 6A) pivotally mounted on a shaft 49 and adapted to swing through an angle of about 90 degrees between the two positions shown in FIGS. 6A and 6C. A plurality of the vacuum pick-up cups 42 are mounted on the gate member 48, adapted to engage a side panel of the lowermost blank 40 in the magazine 12. Clockwise movement of the gate member 48 after engagement with a blank causes such blank to commence opening by snapping past stop abutments 50 at the bottom of the magazine 12. With further arcuate movement of the gate member, the right-hand lateral edge of the blank 40 is cammed against a fixed guide 52 (FIG. 6B), progressively opening the blank still further until it reaches its fully opened position (FIG. 6C) at the end of the arcuate travel of the gate member 48, whereupon it is deposited on the small conveyor 46. Actuation of the gate member 48 is occasioned by external means (not shown) pulling on a rod 53 (FIG. 6B) pivotally mounted on a yoke 54 secured to the shaft 49.

The blank loader assembly 16 typically comprises the endless chain 46 having an outwardly projecting finger 56 formed thereon. The chain is arranged to move the finger through a stroke generally parallel to the side walls of the squared blank 44. In the course of such movement, the finger engages the rear outer edge of a bottom closure panel. When this occurs, the vacuum cups 42 on the gate member 48 release the blank and the latter is urged along fixed guides (not shown) until it telescopes over an aligned mandrel 22 of the indexing mandrel assembly 18.

Once loaded, the mandrel assembly 18 indexes from the load station A to a bottom panel pre-breaker station B in the 2:00 o'clock position, prior to indexing to a bottom panel heat station C in the 12:00 o'clock position. The next index is to the bottom panel tuck and pressure station D at 10:00 o'clock, followed by transfer to a station E which may be used as a second pressure station at 8:00 o'clock, and finally indexing to a discharge or stripper station F at 6:00 o'clock as a bottom-sealed container 58 (FIG. 3C). The stripping of the bottom-sealed container 58 from each successive mandrel 28 is effected by a reciprocally actuated mechanical stripper 60 (FIG. 1) having a rubber vacuum cup 62 mounted on the end thereof for engagement with the closed and sealed bottom of the container 58.

In general, once the sealing of the bottom closure is completed, the container 58 is pulled downwardly by the mechanical stripper 60 from the mandrel 22 at station F and deposited on a suitable conveyor, represented at 64 in FIG. 2. The open-topped container 58 is thereafter acted upon at a top pre-breaker station G, such pre-breaking serving to facilitate the subsequent folding and sealing of the top closure. The container 58 is next conveyed to a filling station H where a measured volume of a product, such as juice, is dispensed into the open end of the container. The container 58 is then caused to encounter a top partial folding or tucking station I, prior to indexing to a heating station J which heats the thermoplastic top closure panels just prior to transfer of the container to a sealing station K where the top closure panels are brought together with a combined pressure and cooling action to become tightly sealed into a completed gable top container 66, prior to delivery to a discharge station L.

The sterilizing process is caused by controls (not shown) to occur intermediate the positions shown in FIGS. 6A and 6C. In other words, the nebulizing nozzle 26 will begin dispensing a sterilant fog into the slightly opened blank 40 just after the nozzle has lowered from the location shown in FIG. 6A to a point just below the plane of the bottom blank, represented by line D in FIG. 6B. This dispensing of sterilant fog is timed to continue until just prior to the blank assuming the full open position shown in FIG. 6C.

The nozzle 26 extends from a nozzle assembly 66 mounted on the distal end of an arm 68 whose other end is pivotally connected to a pivot pin 70. The line 28 supplying the sterilant from the generator (FIG. 1) to the nozzle assembly 66 is a flexible line so as to be able to move through the arc traversed by the assembly 66. An adjustable connector member 72 is pivotally connected at its ends respectively to the nozzle assembly 66 and the yoke 54. Thus, as the yoke pivots about the shaft 54, the arm 68 is caused by the connector member 72 to pivot about the pin 70.

Concurrently, the bottom blank 40 is being progressively opened by the suction cups 42, as may be noted in FIG. 6B and as described above.

During the blank opening process, and while the nozzle 26 moves through an arcuate path about the point 70, relative to the progressively changing opening of the blank 40, the nozzle 26 will traverse a path substantially along the vertical center line of the blank, beginning approximately at the horizontal center of the blank (FIG. 6B), and rising to the upper portion of the fully opened blank (FIG. 6C).

A flexible air line 74 is connected between a source of air under pressure (not shown) and the nozzle assembly 66 for cooperation with internal piston means (not shown) and external timer means to start and stop the spray through the nebulizing nozzle 26 in a suitable timed manner.

Figure 4A:
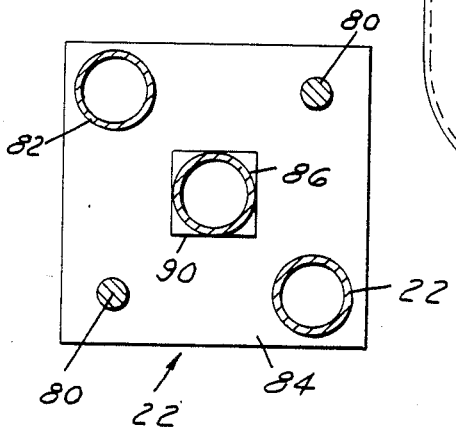
FIG. 4A is a cross-sectional view taken along the plane of the line 4A—4A of FIG. 4, and looking in the direction of the arrows.

As may be noted in FIG. 4, a flexible line 76 is secured at one end thereof to an opening 78 formed in a cover member 80 mounted on the hub 24 of the mandrel assembly 18. Hot air, mixed with compressed air from an external source (not shown) and drawn by suitable means, represented at 79, is supplied through the line 76 from a suitable heater means, which may consist of either the readily available bottom panel heat station C or a separate heat source, to the interior of the hub via the opening 78 and, thence, into and through the open-sided mandrels 22. Each mandrel 22 may be constructed as shown in FIGS. 4 and 4A, i.e., it may include four corner posts, two alternate posts 80 being solid rods and the other two alternate posts 82 being hollow tubes with suitable provisions (not shown) for being water cooled. The four posts are retained at the distal end thereof by an end plate and at the other end by the hub 24. A further tube 86 is mounted in the center of the four corner posts so as to communicate via an opening 88 with the interior of the hub 24. The distal end of the tube 86 is covered with an end plate 90. Fours sets of three slotted openings 92, 94 and 96 are formed equidistantly around the tube 86 to emit the hot air therethrough and into contact with the inner surfaces of each tube 44.

While the sterilant may be any suitable solution, in the event that hydrogen peroxide is used as the sterilizing agent, it is recommended that a drying or heating tunnel (not shown) be employed between stations F and G, which would serve to remove the hydrogen peroxide residue from inside the container prior to the filling of the container with the desired product at station H. However, the heat from the bottom panel heat station C via the line 76 is believed to be sufficient to enhance the action of a sterilant such as chlorine dioxide within the tube 44.

INDUSTRIAL APPLICABILITY

It should be apparent that the inventive sterilization apparatus provides an improved means for initiating the sterilization of carton blanks while being formed into a tube, prior to being formed into bottom-sealed containers, rather than after the bottom forming operation at a remote station along a forming, filling and sealing machine, thereby substantially increasing the sterilizing time allotted to each carton. The sterilization process is enhanced by the addition of warm air to the carton tube via the mandrel while the bottom closure is being formed.

While but one embodiment of the invention has been shown and described, other modifications thereof are possible within the scope of the following claims.

We claim:

1. A forming, filling and sealing machine including an indexing mandrel assembly having a plurality of radially extending mandrels and associated heat and tuck and pressure stations; a magazine for storing folded-over, flattened paperboard container blanks whose free edges are sealed together; suction means for removing said folded-over, flattened blanks one-at-a-time from said magazine; feeding means for opening each of said blanks into a four-sided, open-ended tubular blank and placing same on one of its sides on conveyor means; in combination with a sterilization apparatus said sterilization apparatus comprising a source of sterilant under pressure; nebulizing means for receiving said sterilant from said source and dispensing same in a fog state; said nebulizing means being operatively connected to said feeding means so as to be aligned with the opening of each respective tubular blank as it is progressively opened while being moved from said magazine to said conveyor by said feeding means, means for dispensing said sterilant fog into and through the adjacent progressively opening end of the blank until just prior to the blank being fully opened and moved toward an axially aligned mandrel of said indexing mandrel assembly by said conveyor means, to thereby provide a maximum sterilizing time for each blank.

2. The combination described in claim 1, further comprising means for heating said plurality of radially extending mandrels to activate said sterilant.

3. The combination described in claim 1, further comprising a shaft pivotable in cooperation with the indexing of said mandrel assembly, and wherein said feeding means includes an arm pivotally mounted on said shaft, and a plurality of suction cups mounted on said arm for engaging one of the bottom sides of each bottom blank in said magazine.

4. The combination described in claim 3, further comprising a fixed wall member located relative to said feeding means so as to be engaged by each said blank being moved by said suction cups to thereby cause each blank to progressively open into a four-sided rectangular tube just prior to being placed on said conveyor means.

5. The combination described in claim 4, further comprising a yoke mounted on said shaft, a pivotally mounted nebulizing means support member, and a connector member pivotally connected to the distal ends of said yoke and said nebulizing means support member for moving said nebulizing means so as to be aimed toward the inside of each said blank from the time that it is initially partly opened until it is fully opened.

6. The combination described in claim 1, further comprising means communicating heated air from a source of heated air to said mandrel assembly and said mandrels.

7. The combination described in claim 6, wherein said source of heated air is said heat station of said indexing mandrel assembly.

8. The combination described in claim 1, wherein said nebulizing means includes a pressurized tank, a nebulizing nozzle, and an interconnecting flexible line.

* * * * *